US007284687B1

(12) United States Patent
Minidis

(10) Patent No.: US 7,284,687 B1
(45) Date of Patent: Oct. 23, 2007

(54) PIZZA TRAY

(76) Inventor: James Dean Minidis, 40320 Nido Ct., Palmdale, CA (US) 93551

( * ) Notice: Subject to any disclaimer, the term of this patent is extended or adjusted under 35 U.S.C. 154(b) by 711 days.

(21) Appl. No.: 10/878,867

(22) Filed: Jun. 28, 2004

Related U.S. Application Data

(63) Continuation-in-part of application No. 10/354,487, filed on Jan. 30, 2003, now abandoned.

(51) Int. Cl.
*B65D 5/46* (2006.01)

(52) U.S. Cl. ..... 229/117.12; 229/486; 229/87.08; 229/119

(58) Field of Classification Search ..... 229/117.12, 229/402, 119, 5.81, 902, 906, 87.08
See application file for complete search history.

(56) References Cited

U.S. PATENT DOCUMENTS

| | | | | |
|---|---|---|---|---|
| 952,365 | A * | 3/1910 | Sharon | 229/402 |
| 1,027,719 | A * | 5/1912 | Fordon et al. | 229/106 |
| 2,002,215 | A * | 5/1935 | Otto | 229/402 |
| 2,794,589 | A * | 6/1957 | Souval | 229/68.1 |
| 3,446,416 | A * | 5/1969 | Epstein | 206/557 |

* cited by examiner

*Primary Examiner*—Tri M. Mai
(74) *Attorney, Agent, or Firm*—Christie, Parker & Hale, LLP

(57) ABSTRACT

The pizza tray may be used for support and carrying food items. A tray of generally oval shape having a pair of straight sides and a pair of rounded ends may include a circular portion. A pair of folds may be located in a carry end that define a pair of side elements that may be folded upwardly.

13 Claims, 3 Drawing Sheets

PIZZA TRAY

This application is a continuation-in-part of U.S. patent application Ser. No. 10/354,487 Jan. 30, 2003. U.S. application Ser. No. 10/354,487 now abandoned.

BACKGROUND OF THE INVENTION

This invention relates to devices used to support or carry a pizza. The new pizza tray may have a handle formed as part of the tray to be configured for handling the tray and pizza.

In general a pizza may be baked or cooked in an oven without being placed in a pan or tray. The pizza may be prepared on a pizza crust and then placed in the oven and removed therefrom by the use of a metal or wood paddle having a handle. The paddles may be difficult to use and may require constant cleaning. If a pan or tray is used with the pizza in cooking, a means to insert and remove the pan or tray may be required.

SUMMARY OF THE INVENTION

The present invention is directed to devices for use in support and carrying food items. A tray of generally oval shape having a pair of straight sides and a pair of rounded ends may include a circular portion. A pair of folds may be located in a carry end that define a pair of side elements that may be folded upwardly.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
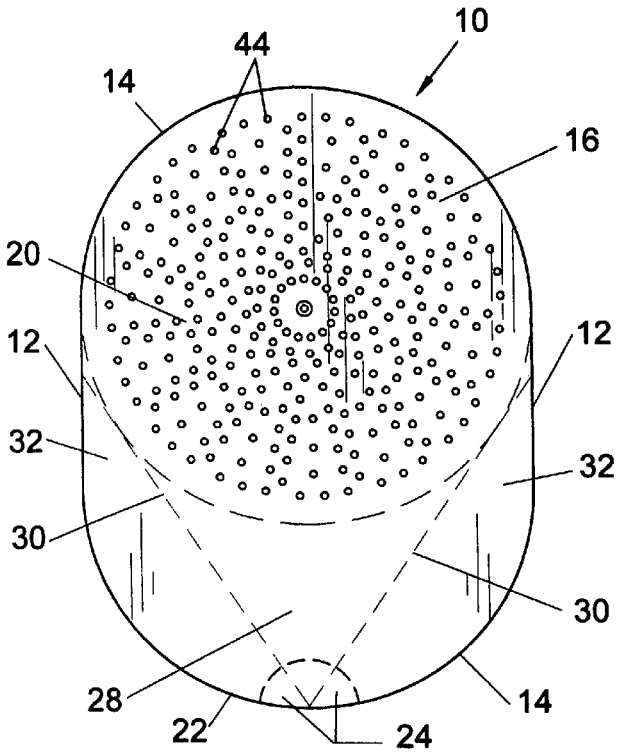
FIG. 1 illustrates a top plan view of the tray according to an embodiment of the invention.
Figure 2:
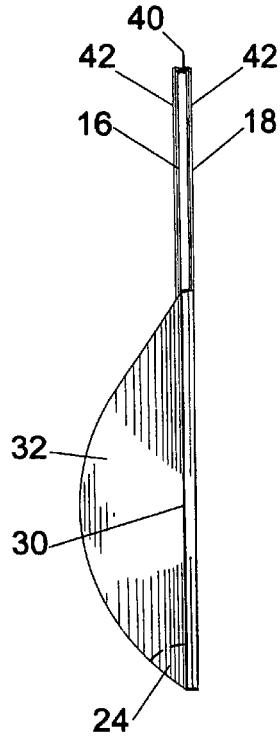
FIG. 2 illustrates a side elevation view of the tray according to an embodiment of the invention.
Figure 3:
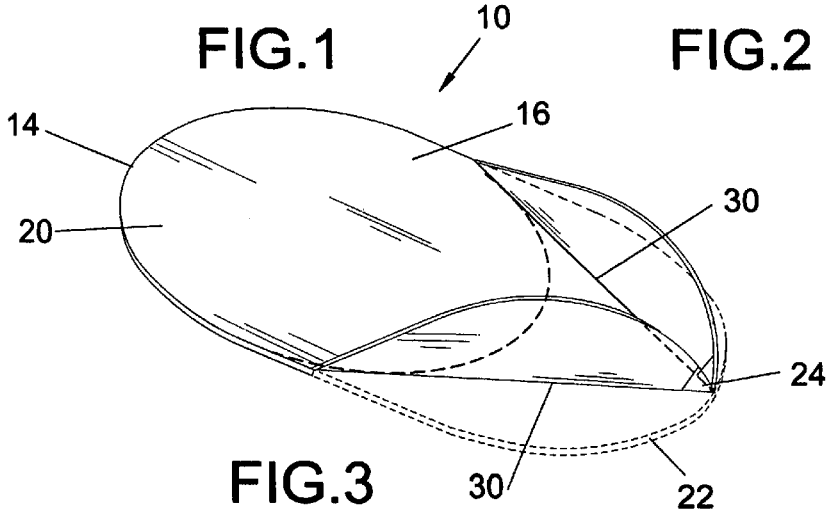
FIG. 3 illustrates a perspective view of the tray according to an embodiment of the invention.

Referring to FIGS. 1 through 3, a pizza tray 10 may be generally oval in shape having straight sides 12 and rounded ends 14. A portion of the tray 10 may be considered to form a circular portion 20 that may be defined by extending an arch 21 of a first end of the rounded ends 14 by rotation at a radius the approximate radius of the circumference of the first end on which a pizza may be placed. The remainder of the tray 10 may have folds 30 formed in carry end 28 by indentation, perforation or like method to serve as folds for side elements 32. The folds 30 may be formed to be approximately tangent to the circular portion 20 and to approximately touch at the tab 24 or a second end of the rounded ends 14.

When the side elements 32 are folded upwardly along folds 30 to an approximate vertical position they may be used as handles to hold the tray 10. This may facilitate placing a pizza placed on the tray 10 in an oven or may be used as a carrying tray for delivery of the pizza to for example a customer. The structural material of the tray 10 and the method of formation of the folds 30 may allow sufficient strength for carrying a pizza with the tray 10 in the flat or nonfolded configuration.

The fold end 22 of the tray 10 may have a tab 24 formed by indentation, perforation or like method. The tab 24 may be folded inwardly to support the side element 32 in the approximately vertical position and may be 1 ½ inches in diameter.

Figure 6:
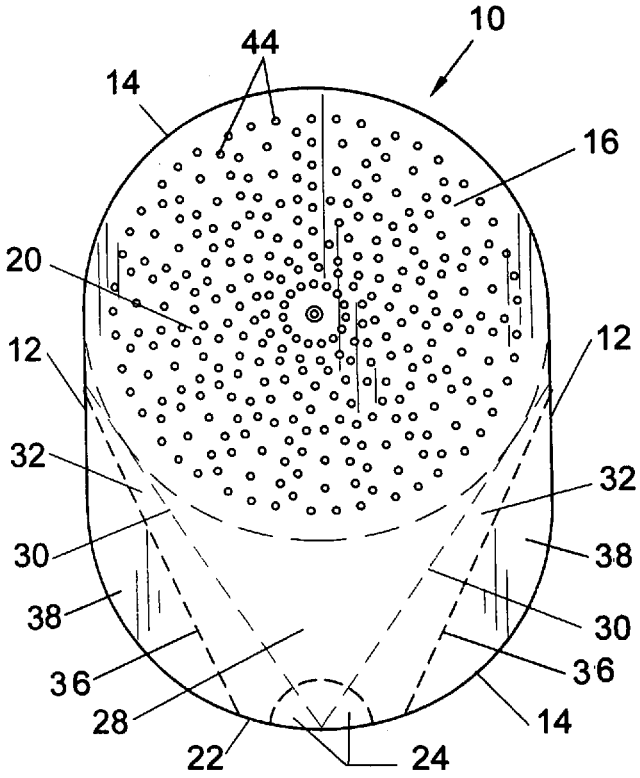
FIG. 6 illustrates a top plan view of the tray having a third pair of folds according to an embodiment of the invention.
Figure 7:
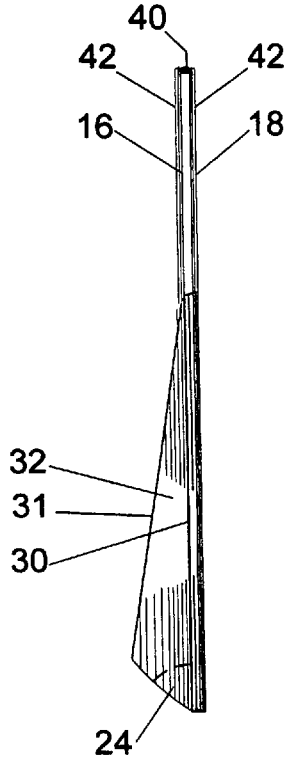
FIG. 7 illustrates a side elevation view of the tray according to an embodiment of the invention.
Figure 8:
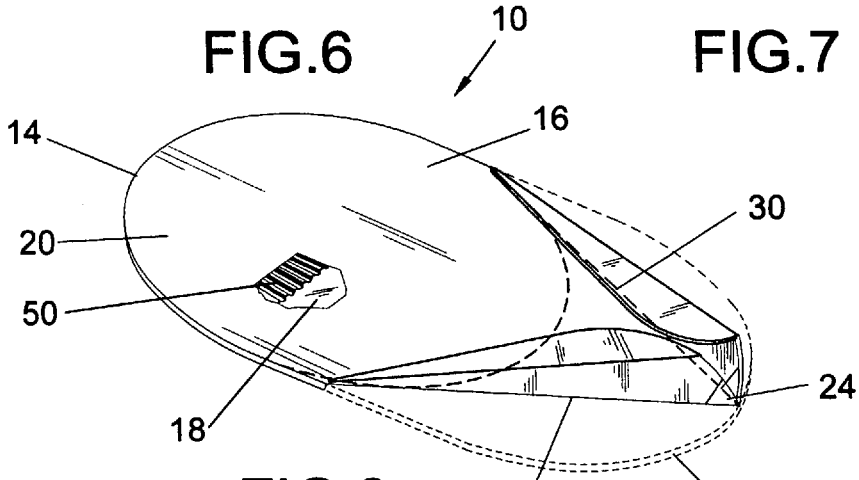
FIG. 8 illustrates a perspective view of the tray according to an embodiment of the invention.

Referring to FIGS. 6 through 8, there may be a third pair of folds 36 formed in the carry end 28 by indentation, perforation or like method to serve to further fold side elements 32 to form a third side element 38. The folding to create the third side elements 38 may serve to allow a user to more easily hold the pizza tray during carrying of a pizza thereon. The third folds 36 may be formed to approximately touch the side elements 32 at a first end and to diverge at an acute angle therefrom intermediate a fold 30 and a straight side 12 as best illustrated in FIG. 6. The third folds may terminate at the circumference of the fold end 22.

The tray 10 may be formed of corrugated paper material 40. The corrugated paper material 40 may have a paper 42 laminated on upper surface 16 and lower surface 18 that may provide further support or stiffening for tray 10. The alternating ridges and grooves 50 of the corrugated paper material 40 may be oriented in the longitudinal direction to be approximately parallel to the straight sides 12. This orientation may improve structural stability when carrying a pizza by holding the tray 10 approximately at the carry end 24.

The corrugated paper material 40 and paper 42 laminates may serve to absorb moisture from a pizza crust bottom surface and may aid in allowing a pizza to slide on the surface for removal. The upper surface 16 may also have perforations 44 to absorb moisture from the pizza crust prior to and after baking.

Figure 4:
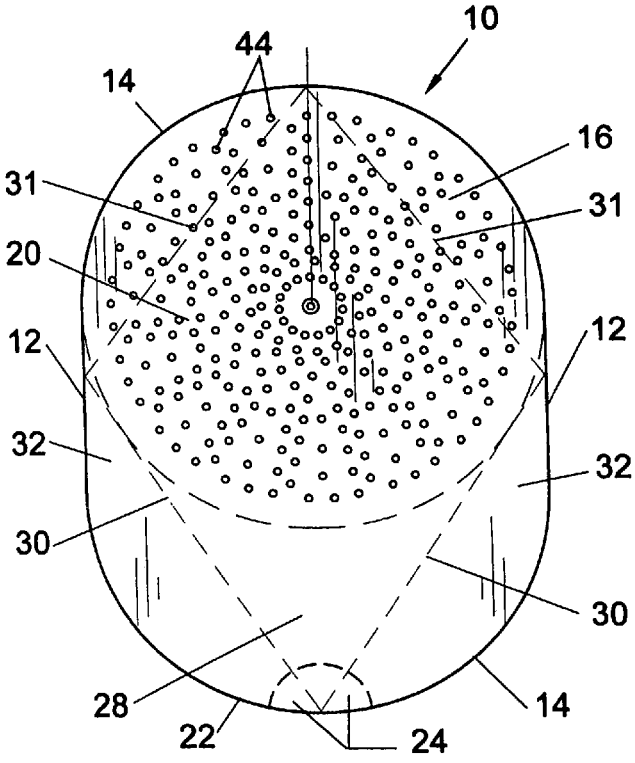
FIG. 4 illustrates a top plan view of the tray according to an embodiment of the invention.
Figure 5:
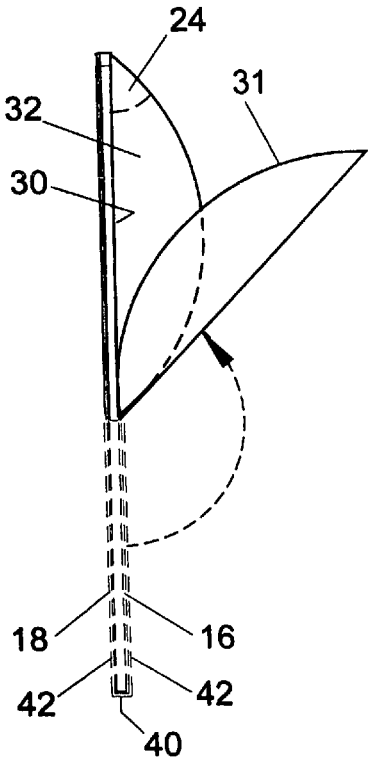
FIG. 5 illustrates a side elevation view of the tray according to an embodiment of the invention.

Referring to FIGS. 4 and 5, the tray 10 may have a second pair of fold lines 31 formed generally in the circular portion 20 by indentation, perforation or like method to serve as fold lines for a second pair of side elements 34. The second fold lines 31 may be formed to approximately touch the side elements 32 at a first end and to approximately touch each other at a second end. As illustrated in FIG. 5, the tray 10 may be folded at its approximate middle to form a carry container to transport food items.

The use of paper and corrugated structure may allow the pizza tray to be a disposable item and to serve as device to aid in the speed of the pizza cooking process. The fold end 22 with elements folded as described may provide support for carrying pizza and to keep a user's hands at a distance from a pizza crust.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for support and carry of food items comprising:

a tray of generally oval shape having a pair of straight sides and a pair of rounded ends;

a circular portion defined by extending an arch of a first one of said rounded ends by rotation at a radius the approximate radius of the circumference of said first one; and a pair of folds extending from each of said straight sides, tangent to said circular portion and convergent to approximately touch at a second one of said rounded ends that define a pair of side elements.

2. The device as in claim 1 wherein there is a tab formed at a fold end of said tray for engagement with said side elements.

3. The device as in claim 1 wherein said tray is formed of a corrugated paper material.

4. The device as in claim 3 wherein a paper is laminated to an upper surface and to a lower surface of said tray.

5. The device as in claim 3 wherein said corrugated paper material having a plurality of alternating ridges and grooves oriented in a longitudinal direction to be approximately parallel to said pair of straight sides.

6. The device as in claim 5 wherein said folds have a plurality of perforations.

7. The device as in claim 1 wherein said circular portion on an upper surface having a plurality of perforations.

8. The device as in claim 1 wherein a second pair of folds located generally in said circular portion that define a second pair of side elements.

9. The device as in claim 8 wherein said second pair of folds are formed to approximately touch said first pair of folds at a first end and approximately touch each other at a second end.

10. The device as in claim 8 wherein said second pair of folds have a plurality of perforations.

11. The device as in claim 1 further comprising:

a third pair of folds wherein one of each of said third pair of folds approximately touches one of each of said first pair of folds at a first end;

each of said third pair of folds diverging at an acute angle from said first end intermediate one of said first pair of folds and one of said pair of said straight sides; and each of said third pair of folds terminating at a circumference of said second one of said rounded ends.

12. A device for support and carry of food items comprising:

a tray of generally oval shape having a pair of straight sides and a pair of round ends;

a circular portion defined by extending an arch of a first one of said rounded ends by rotation at a radius the approximate radius of the circumference of said first one;

a pair of folds extending from each of said straight sides, tangent to said circular portion and convergent to approximately touch at a second one of said rounded ends that define a pair of side elements; and said tray is formed of a corrugated paper material with a paper laminated to an upper surface and to a lower surface.

13. A device for support and carry of food items comprising:

a tray of generally oval shape having a pair of straight sides and a pair of round ends;

a circular portion defined by extending an arch of a first one of said rounded ends by rotation at a radius the approximate radius of the circumference of said first end;

a pair of folds extending from each of said straight sides, tangent to said circular portion and convergent to approximately touch at a second one of said rounded ends that define a pair of side elements;

said tray is formed of a corrugated paper material with a paper laminated to an upper surface and to a lower surface;

a second pair of folds located generally in said circular portion that touch said first pair of folds at a first end and approximately touch each other at a second end that define a second pair of side elements; and said circular portion on an upper surface having a plurality of perforations.

* * * * *